United States Patent [19]

Sato et al.

[11] Patent Number: 4,805,565

[45] Date of Patent: Feb. 21, 1989

[54] STRUCTURE OF CAM SHAFT FOR ENGINE

[75] Inventors: Masato Sato, Akashi; Keiichi Nakamizo, Hyogo; Takashi Mitadera, Akashi, all of Japan

[73] Assignee: Kawasaki Jukogyo Kabushiki Kaisha, Japan

[21] Appl. No.: 108,078

[22] Filed: Oct. 14, 1987

[30] Foreign Application Priority Data

Dec. 9, 1986 [JP] Japan ..... 61-292953

[51] Int. Cl.[4] ..... F01L 1/04; F01M 9/10

[52] U.S. Cl. ..... 123/90.6; 123/90.34; 123/196 W

[58] Field of Search ..... 123/90.6, 90.33, 90.39, 123/90.27, 196 W

[56] References Cited

U.S. PATENT DOCUMENTS 2,969,051 1/1961 Webster ..... 123/90.18
4,352,344 10/1982 Aoyama et al. ..... 123/90.18
4,516,541 5/1985 Yungclas ..... 123/196 W
4,688,529 8/1987 Mitadera et al. ..... 123/196 R

FOREIGN PATENT DOCUMENTS 0167210 10/1982 Japan .
0052323 11/1982 Japan .

*Primary Examiner*—Willis R. Wolfe
*Assistant Examiner*—M. Macy
*Attorney, Agent, or Firm*—Leydig, Voit & Mayer

[57] ABSTRACT

A cam shaft for engine is constructed such that the cam shaft driven by a crankshaft is rotatably supported at both ends by respective journal bearing boxes. Either one of the journal bearing boxes is fed with pressure oil from an oil pump to cause the oil pressure gathered within the journal bearing box to act upon the end face of the cam shaft so that the cam shaft is normally biased in a constant axial direction.

6 Claims, 4 Drawing Sheets

STRUCTURE OF CAM SHAFT FOR ENGINE

BACKGROUND OF THE INVENTION

This invention relates to an improved structure of a cam shaft for use in an engine.

In a hitherto known engine, it has been common in design to employ a crankshaft and a cam shaft arranged such that the former drives the latter through a helical crank gear. In such engine wherein usually the cam shaft is made of cast iron while journal bearing boxes for supporting opposite ends of the cam shaft are made of aluminium, there involves the necessity of maintaining an axial clearance of a certain size between both ends of the cam shaft and its respective bearings in order to secure smooth rotation of the cam shaft even at extremely low temperatures. However, the problem may arise in that when either one of the valves is caused to move by its associated cam (or when the valve is about to open), the cam shaft tends to be biased in an axial direction either upwardly or downwardly under the influence of an axial component of force acting on the helical crank gear, so that the shaft abuts against the end face of that bearing box toward which it has moved, thereby making striking sounds. When the valve then reverses its motion from opening to closing after passing over the point of maximum cam lift, there occurs an instantaneous change of direction in which the force acts in the rotational direction of the cam shaft, so that the axially directed component of force acting on the helical crank gear reverses its axial direction, biasing the cam shaft now in the opposite direction, thereby causing the cam shaft to abut against the end of the bearing opposite to the preceding one. Concerning this axial movement of the cam shaft occurring repeatedly during the engine operation, the result is that the greater the size of clearance (the extent of axial motion) is selected, the higher the level of striking sound being produced becomes. This objectionable noise continues to take place in a repeated manner as long as the engine operates. Empirically, the striking sound tends to be most intensified when the engine operates at a low speed, thus aggravating the problem of noise in the engine operation. Moreover, it has been usual in practice that shim means is applied between the cam shaft and the end face of either one of the bearings so as to permit adjustment of the clearance therebetween to an optimum value since the clearance obtained in manufacture tends to fluctuate in size due to the possible occurrence of accumulative machining tolerances of all related parts.

In the above prior structure, the problem remains that it requires a number of man-hours for shim adjustment and it does not completely eliminate the above mentioned striking sound because the provision of clearance is essentially necessary.

The invention, therefore, aims to settle those problems mentioned above, by reducing the striking sound without the use of shims.

SUMMARY OF THE INVENTION

To settle the prior problem mentioned above, the invention provides an arrangement of a cam shaft for an engine wherein a crankshaft and a cam shaft are provided with the former driving the latter through a helical crank gear, characterized in that both ends of the cam shaft are rotatably supported on respective journal boxes either one of which journal boxes communicates with a pressure oil supply passage from an oil pump, so that the oil pressure within that journal box acts upon the end face of the cam shaft thereby normally biasing the cam shaft in a constant axial direction.

The inventive arrangement operates as follows. During the engine operation, lubricating oil from the oil pump is forcibly fed into one of the journal bearing boxes through the oil pressure supply passage. In consequence, the lubricating oil within the journal bearing box rises in pressure, acting upon the end face of the cam shaft in such manner that the cam shaft is normally constantly biased in an axial direction toward the other journal bearing box. It is assured, therefore, that even if the cam shaft is acted upon, when the valve is moved by the respective cam, by an axial component of force from the helical crank gear, there will be produced striking sounds which are significantly damped or lowered in level because the clearance between the cam shaft and the other journal bearing box is almost zero. Since, furthermore, the cam shaft is kept biased in one axial direction by oil pressure, it in no case occurs that the cam shaft disadvantageously moves reversely.

DESCRIPTION OF THE PREFERRED EMBODIMENT

The invention will now be described by its embodiments and with reference to the drawings.

[Embodiment 1]

Figure 1:
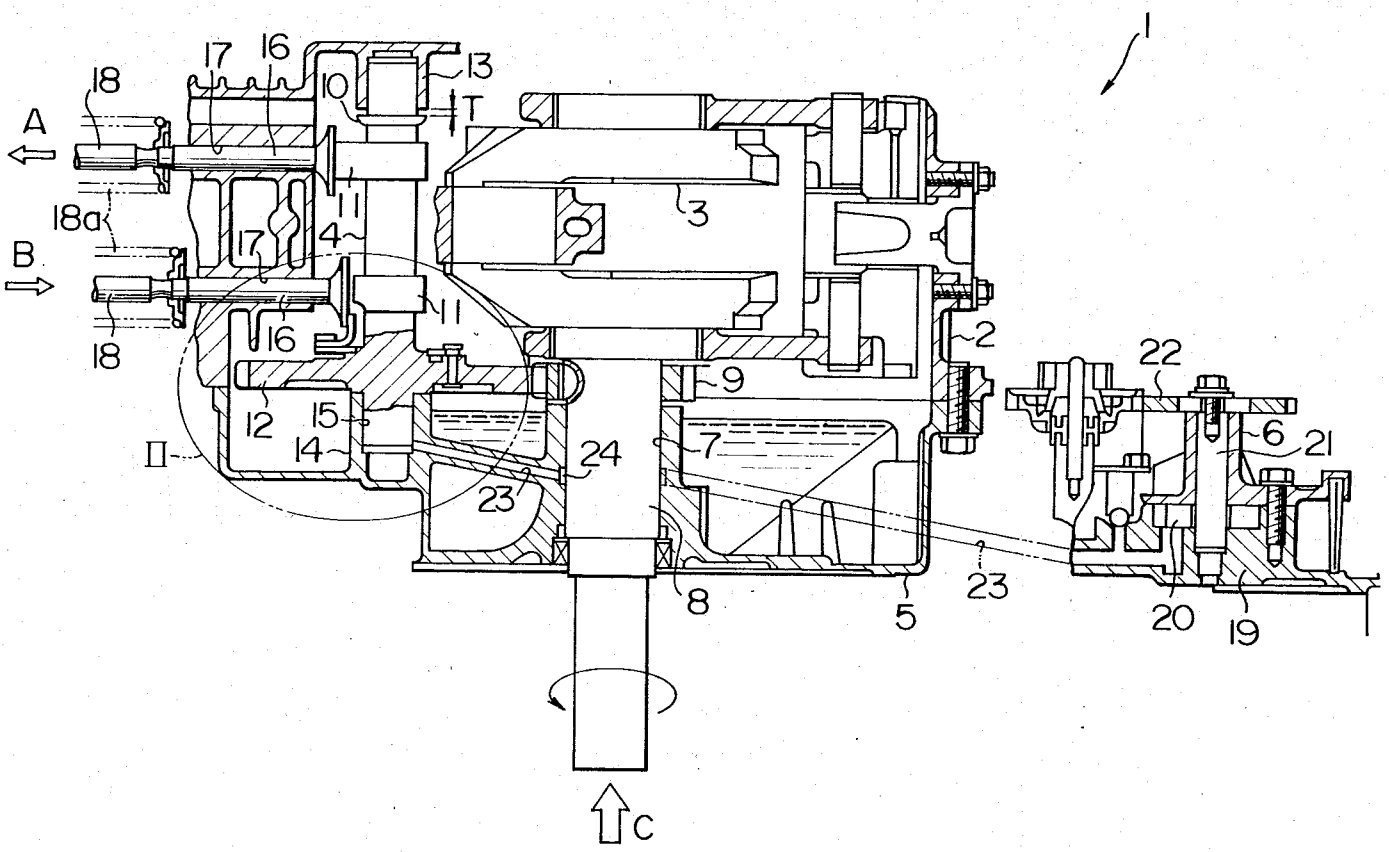
FIG. 1 is a longitudinal sectional view of a vertical engine constructed according to a preferred embodiment of the invention.
Figure 2:
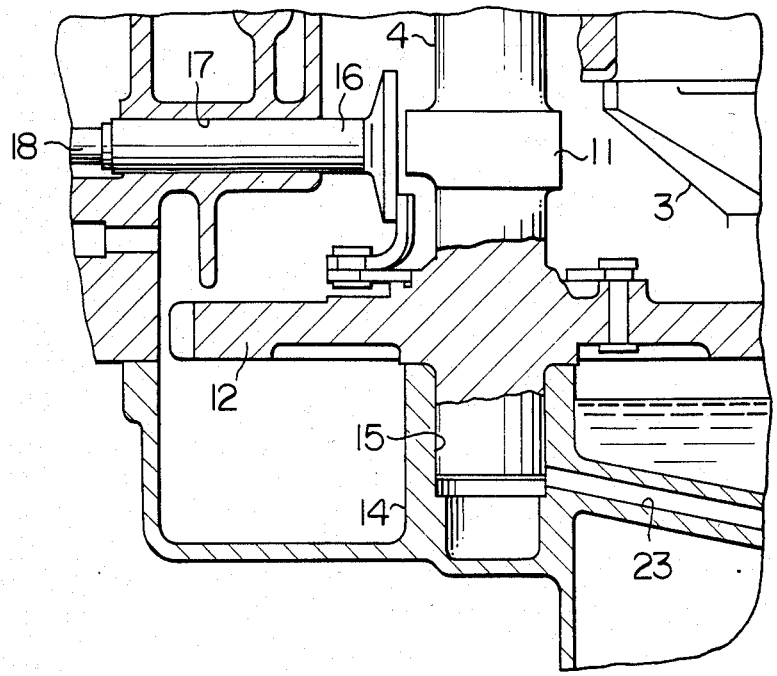
FIG. 2 is an enlarged sectional view of a detail encircled as at II in FIG. 1.

As shown in FIGS. 1 and 2, this example is a first embodiment of the invention wherein an oil pump is mounted separately from the cam shaft.

FIG. 1 shows a vertical axis type engine 1 including a crankshaft 3 and a cam shaft 4, both extending vertically, within a crank case 2, and an oil pump 6 disposed within a crank case cover 5. The crankshaft 3 is rotatably supported on the crank case 2 through a main bearing 7, its journal portion 8 extending downwardly outwardly through the crank case cover 5. Around the proximal end of the journal portion 8 is mounted a crank gear 9 in the form of a helical gear. The cam shaft 4 is formed with an annular thrust collar 10, a plurality of cams 11 and a cam gear 12, at the upper end portion, in the middle portion, and at the lower end portion thereof, respectively. The upper and lower ends of the cam shaft 4 are rotatably supported on an upper journal bearing box 13 formed integral with the crank case 2 and on a bearing surface 15 of a lower journal bearing box 14 formed integral with the crank case cover 5. There is provided a clearance of a certain size T maintained between the upper end face of the thrust collar 10 and the lower end face of the upper journal bearing box 13. In confronting relation to each cam 11 is inserted its cooperating tappet 16 through an associated guide hole 17 formed in the crank case 2 in such manner that by actuation of each cam 11, its cooperating valve 18 which has been biased in the arrow-indicated direction B, is moved in the arrow-indicated direction A. The cam gear 12 is of the helical type for meshing engagement with the crank gear 9, through which cam gear 12 rotation of the crankshaft 3 is transmitted to the cam shaft 4. The oil pump 6 serves to distribute lubricating oil forcibly to necessary parts of the engine, and is for example of the torochoidal pump type. This pump 6 is so constructed that its rotor 20 is rotatably disposed within a pump casing 19 formed on the crank case cover 5 with a rotary shaft 21 having at its end a pump gear 22. The pump gear 22 in the form of a helical gear meshing with the crank gear 9 serves to transmit rotation of the crankshaft 3 to the rotor shaft 21. There is provided a pressure oil supply passage 23 which is branched off from the delivery side of the oil pump 6 and is in fluid communication with and within the lower journal bearing box 14 through an annular groove 24 formed on the inner periphery of the main bearing 7 in the crank case cover 5, as is shown in detail in FIG. 2.

The operation of the embodiment given above will now be described. When the engine 1 operates, the crankshaft 3 drivingly rotates the cam shaft 4 and oil pump 6 through the cam gear 12 and pump gear 22 in mesh with the crank gear 9. When the cams 11 alternately move their associated valves 18 through the tappets 16 (when the valves begin to open), the cam shaft 4 is prevented for a moment from rotation by a restraining force of the spring 18*a* (acting in the arrow-indicated direction B) though the cam gear 12 tends to be rotated by the crank gear 9. At this moment, when the crankshaft 3 rotates counterclockwise looking in a direction indicated by the arrow C in FIG. 1, and the crank gear 9 is a right hand gear, the cam shaft 4 is subject to an axial component of force, and is forced to be lifted up by a distance T, so that the upper end face of the thrust collar 10 strikes against the bottom end face of the upper journal bearing box 13. A moment later, the valve reverses its motion from opening to closing after having passed over the maximum cam lift, and the cam shaft 4 is relieved of its state of being pushed upwardly as described above. As the spring 18*a* then acts to exert a force to cause the cam shaft to be rotated, the cam shaft 4 is acted upon by a force to be driven downwardly in contrast with the above. This cycles with every revolution of the engine.

On the other hand, the engine is lubricated around its necessary parts by lubricating oil under pressure from the oil pump 6. Some of that lubricating oil is dispensed through the pressure oil supply passage 23, lubricating the bearing portion 7 for the crank shaft 3 through the annular groove 24, and thence flows into the lower journal bearing box 14 for the cam shaft 4. The thus introduced inflow of lubricating oil serves to lubricate the lower end portion of the cam shaft 4. On the other hand, the bottom face of the latter is acted upon by an increasing oil pressure prevailing within the lower journal bearing box 14 to be raised in such manner that the upper end face of the thrust collar 10 is kept normally biased upwardly against the bottom face of the upper journal bearing box 13. The clearance T, therefore, is maintained as almost zero. This is a reason why there will only be produced striking sounds of significantly reduced level even when the upper end face of the thrust collar 10 strikes against the bottom face of the upper journal bearing box 13.

[Embodiment 2]

Figure 4:
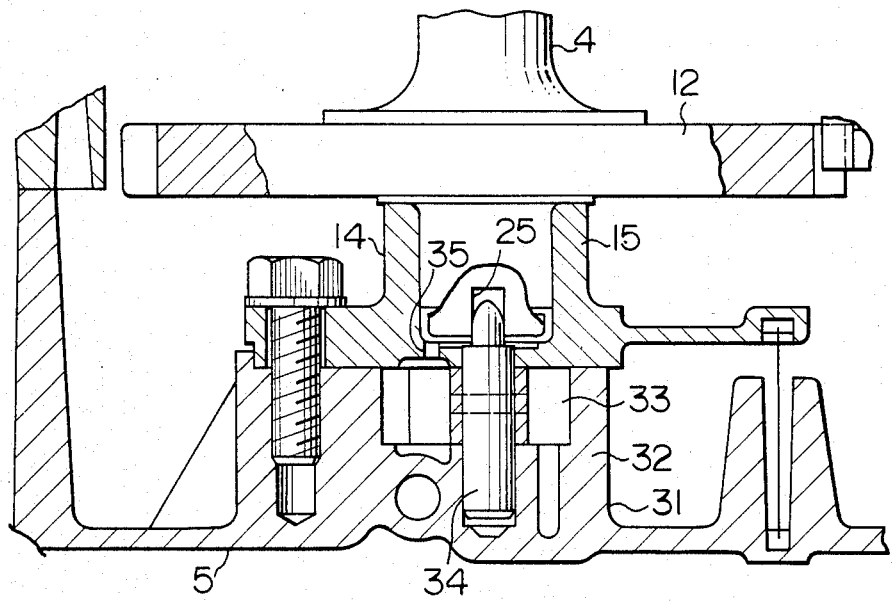
FIG. 4 is an enlarged sectional view of a detail encircled as at IV in FIG. 3.
Figure 3:
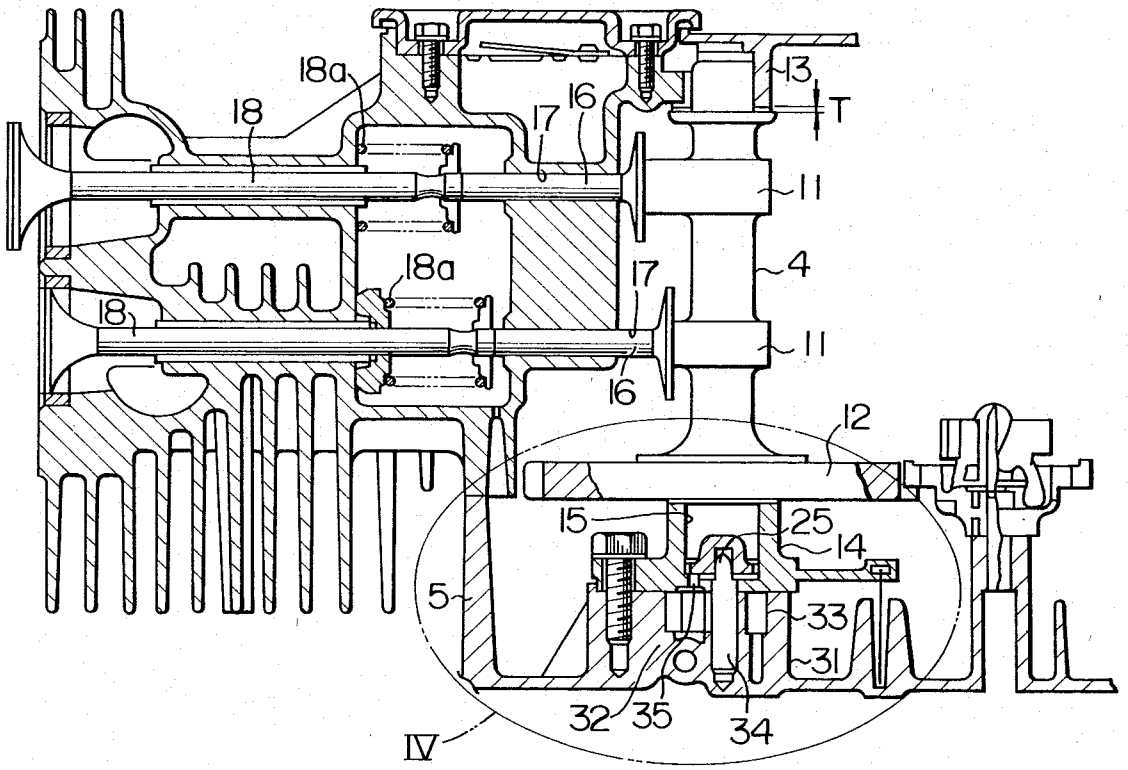
FIG. 3 is also a longitudinal sectional view of a vertical engine however according to an altered embodiment of the invention.

This example, as shown in FIGS. 3 and 4, is an altered embodiment wherein the oil pump is mounted immediately below the cam shaft. The same reference numerals as in Embodiment 1 are used here for corresponding parts.

The numeral 31 indicates an oil pump which is coupled with the lower end of the cam shaft 4. The lower end of the cam shaft in turn is rotatably supported on a bearing surface 15 of a lower journal bearing box 14 fixedly secured on the crank case cover 5, and is formed at its bottom face with a retainer hole 25.

The oil pump 31 is constructed such that it has a rotor 33 fitted in a pump casing 32 formed on and integral with the crank case cover 5, the upper end of its rotor shaft 34 extending through the bottom of the lower journal bearing box 14 into engagement in the above-mentioned retainer hole 25. Upwardly from the delivery side of the rotor 33 is branched off a pressure oil supply passage 35 which is in fluid communication with the interior of the lower journal bearing box 14. With such arrangement, when the engine 1 operates, the crankshaft 3 (See FIG. 1) drives the cam shaft 4 through the cam gear 12 meshing with the crank gear 9 (See FIG. 1), and the cam shaft 4 in turn drives the oil pump 31 through the retainer hole 25. Some of the lubricating oil to be forcibly fed from the oil pump 31 flows into the pressure oil supply passage 35 and thence into the lower journal bearing box 14, thereby lubricating the lower end portion of the cam shaft. At the same time, the oil being accumulated within the lower journal bearing box 14 gathers pressure. This oil pressure acts upon the lower end face of the cam shaft 4 so as to raise the shaft, thereby attaining the same function and effectiveness as in the above described Embodiment 1.

Figure 5:
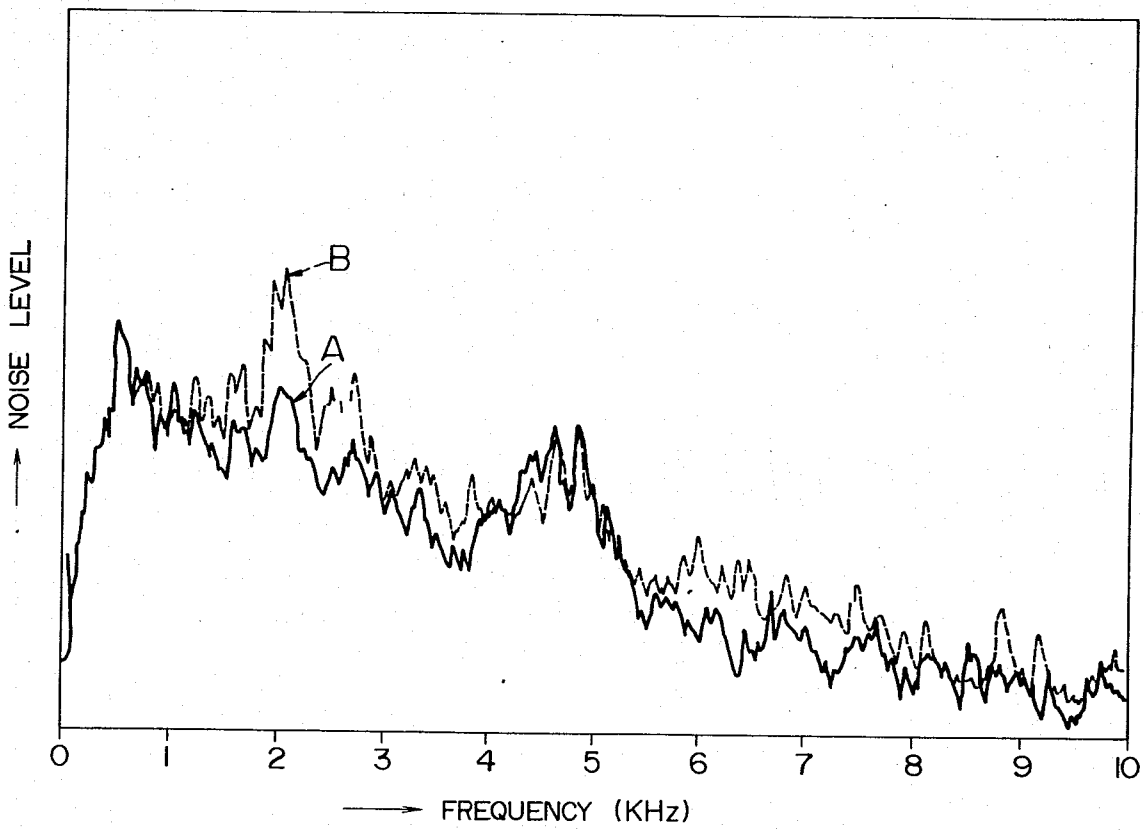
FIG. 5 is a graphic diagram showing results of a noise test associated with the invention.

For reference, FIG. 5 shows a result of a noise test performed by the present inventor. The test was carried out with the clearance T being selected as 0.1 mm to 0.15 mm for the conventional structure and 0.4 mm for the inventive structure, and with no-load operation of the engine at 1,400 rpm. In FIG. 5, the abscissa represents frequencies of noise sound ($KH_z$), and the ordinate represents noise levels, wherein a level curve A is obtained for a cam structure of the invention whereas a level curve B is obtained for that of the conventional structure. As will be apparent from the same Figure, it is admitted that according to the invention there are provided reduced noises consistently throughout the whole range of frequency however except a specific minor range around 5 $KH_z$, a remarkable effect being displayed, among others, around 2 $KH_z$, though the striking sound would otherwise be greater in proportion to such a comparatively larger clearance as selected in this test.

With such an arrangement of the invention as described so far, is advantageously assured that during the engine operation, the cam shaft is normally biased by oil pressure in a constant axial direction to such an extent that the clearance between the end face of the cam shaft and the bottom face of the journal bearing box is maintained almost as zero. Even if the cam shaft is acted upon by an axial component of force produced in the helical gear in mesh when each cam drives its associated valve, the level of striking sounds occurring between the end face of the cam shaft and the bottom face of the journal bearing box is extremely low. The invention also provides an advantage there is the shim adjustment being dispensed with because of no necessity to use shims in the clearance.

What is claimed is:

1. Structure of a cam shaft for engine having a crankshaft provided with a helical crank gear and a cam shaft provided with a helical cam gear meshing with said crank gear and rotatably supported at both ends thereof by journal bearing boxes, characterized in that either one of said journal bearing boxes is communicated with a pressure oil supply passage, thereby causing the oil pressure produced within said one journal bearing box to act upon the end face of the cam shaft so that the cam shaft is normally biased in a constant axial direction.

2. Structure of a cam shaft according to claim 1 wherein said pressure oil supply passage is in communication at one end thereof with an oil pump.

3. Structure of a cam shaft according to claim 2 wherein said pressure oil supply passage is in communication with the lower journal bearing box.

4. Structure of a cam shaft according to claim 3 wherein said oil pump is disposed separately from the cam shaft.

5. Structure of a cam shaft according to claim 2 wherein said oil pump is disposed vertically and is located immediately below the cam shaft.

6. Structure of a cam shaft according to claim 5, said oil pump having a rotor shaft coaxial with said cam shaft and driven thereby, said oil pump being separated from said journal bearing box by means of a partition wall having a pressure oil supply passage.

* * * * *